US005713509A

United States Patent [19]

Correll

[11] Patent Number: 5,713,509

[45] Date of Patent: Feb. 3, 1998

[54] CONVERTIBLE BOX

[76] Inventor: John D. Correll, 8459 Holly Dr., Canton, Mich. 48187

[21] Appl. No.: 311,396

[22] Filed: Sep. 23, 1994

Related U.S. Application Data

[63] Continuation-in-part of Ser. No. 86,318, Jul. 6, 1993, abandoned.

[51] Int. Cl.[6] ..... B65D 5/22; B65D 5/42

[52] U.S. Cl. ..... 229/109; 229/120; 229/152; 229/906; 229/935

[58] Field of Search ..... 229/109, 120, 229/150, 152, 902, 906, 101, 110, 933, 935

[56] References Cited

U.S. PATENT DOCUMENTS

| | | | |
|---|---|---|---|
| 1,634,596 | 1/1927 | Schurmann . | |
| 1,939,744 | 12/1933 | Wellman | 229/101 |
| 2,435,283 | 2/1948 | Lighter | 229/935 |
| 2,751,138 | 6/1956 | Laver | 229/109 |
| 2,756,919 | 1/1956 | Davidson . | |
| 3,003,674 | 1/1961 | Ringler . | |
| 3,572,576 | 3/1971 | Foster . | |
| 3,923,234 | 12/1975 | Lund, Jr. | 229/109 |
| 4,238,068 | 12/1980 | Ellerbe et al. | 229/101 |
| 4,765,534 | 8/1988 | Zion et al. | 229/109 |
| 4,919,326 | 4/1990 | Deiger | 229/109 |
| 4,984,734 | 1/1991 | Zion et al. | 229/109 |
| 4,993,625 | 2/1991 | Stease et al. | 229/109 |
| 5,000,374 | 3/1991 | Deiger | 229/109 |
| 5,071,062 | 12/1991 | Bradley et al. | 229/109 |
| 5,110,039 | 5/1992 | Philips | 229/110 |
| 5,211,329 | 5/1993 | Patton | 229/110 |
| 5,249,550 | 10/1993 | Hines et al. | 229/101 |
| 5,381,949 | 1/1995 | Correll | 229/935 |
| 5,402,929 | 4/1995 | Ritter et al. | 229/110 |
| 5,553,771 | 9/1996 | Correll | 229/110 |
| 5,586,716 | 12/1996 | Correll | 229/110 |

FOREIGN PATENT DOCUMENTS

| | | | |
|---|---|---|---|
| 1290796 | 3/1962 | France . | |
| 2676035 | 11/1992 | France . | |
| 3933372 | 4/1991 | Germany . | |
| 823270 | 11/1959 | United Kingdom | 229/120 |
| 825555 | 12/1959 | United Kingdom . | |

*Primary Examiner*—Gary E. Elkins

[57] ABSTRACT

A type of box comprising at least five walls yet with the capability of having the appearance of a square box, with a convertible corner feature that allows conversion of a diagonal wall to a square corner for carrying extra items, and with sloping side walls that allow multiple blanks to be inverted and mated for material savings. Also disclosed is a method for partially folding and nesting the box for conserving storage space used for set up boxes and a method for expanding and contracting the size of the inner cavity of the box.

28 Claims, 5 Drawing Sheets

12
73
41b
40b
49b
42b
46
62
36b
35b
60
30
52
49a
41a
42a
36a
35a
40a
45
43
41c
42c
40c
31
51

11
61
63
62
64
65
82
66
60
54
52
32
30
31
51
56
53
55
80
71
72
49a
40a
41a
42a
36a
35a
45
39a
33
43
47
39c
35c
36c
41c
42c
40c
49c
36b
35b
39b
34
44
39d
35d
36d
41d
42d
40d
49d
46
48
40b
49b
42b

CONVERTIBLE BOX

CROSS REFERENCES TO RELATED APPLICATIONS

This is a continuation-in-part application of my application Ser. No. 08/086,318, entitled "Box with Convertible Corner," filed on Jul. 6, 1993, now abandoned.

FIELD OF THE INVENTION

This invention relates to boxes and blanks made of foldable material and, in particular, to boxes for relatively flat food products such as pizza and the like.

DESCRIPTION OF THE PRIOR ART

In the pizzeria industry, the cost of the box for delivery and carry-out pizza is a substantial part of the total cost of the product and, therefore, a concern of many pizza companies. The main cost component of corrugated pizza boxes is the material consumed in making the blank. To achieve a minimum amount of material consumption during manufacture of blanks, a blank should be capable of inverted mating or nesting during manufacture of multiple blanks. In addition, it should eliminate any unnecessary material, thereby resulting in a blank of shorter end-to-end and side-to-side dimensions.

In addition, many consumers are concerned about wasteful consumption of natural resources. To achieve good relations with environmentally-conscious customers, many pizza companies would benefit from a box that conserves a maximum amount of material and, therefore, natural resources.

Further, a box must meet the performance requirements of pizza companies. Some of those companies want to contain the product on eight sides so as to reduce slice separation during transit. In addition, some also desire to have at least one square corner on a box for accommodating storage of an extra item, such as a small cup of sauce or a packet of spices. To provide a box that includes eight side walls plus a square corner for carrying an occasional extra item, a means is needed whereby a diagonal wall can be converted to a square corner, and vice versa. Further, while an octagon box provides certain performance advantages, some pizza companies prefer the appearance of a square box or, specifically, the looks of a square cover. Therefore, it would be advantageous to have a box that has eight side walls yet has a square cover and full-length rectangular front and rear wall panels, thereby giving the box a square appearance.

Further, some companies might like to have a box with eight rigid walls, to provide maximum product containment, and also like to be able to cut the pizza in the box. However, an eight-sided box with rigid walls does not have enough room within the inner cavity of the box to allow in-box cutting. Therefore, it would be advantageous to have an eight-sided box that has walls that can be easily moved from an inward position to an outward position, thereby allowing in-box pizza cutting, and then easily moved back to the inward position to contain the product.

Finally, many pizza companies pre-fold, or set up, pizza boxes one or more days ahead of usage. As a result, a typical pizzeria can have hundreds of set up boxes within the store. This consumes considerable storage space. So, it would be beneficial to have a means for reducing the amount of storage space required by set up boxes.

In recent years several octagon-shaped pizza box designs have been invented. In addition, a couple six-sided designs have occurred as well. Examples include Zion et al. U.S. Pat. No. 4,765,534 granted on Aug. 23, 1988, Zion et al. U.S. Pat. No. 4,984,734 granted on Jan. 15, 1991, Deiger U.S. Pat. No. 5,000,374 granted on Mar. 19, 1991, Bradley et al. U.S. Pat. No. 5,071,062 granted on Dec. 10, 1991, Philips U.S. Pat. No. 5,110,039 granted on May 5, 1992, and Patton U.S. Pat. No. 5,211,329 granted on May 18, 1993. However, none of the prior art has adequately solved the above-described problems, but my invention does.

In conclusion, it would be highly desirable to provide an octagon box that overcomes the above-described problems and disadvantages.

OBJECT AND ADVANTAGES

Accordingly, the object of my invention is a type of pizza box that does one or more of the following: (1) can be manufactured using a minimum amount of material per blank (i.e., can be produced in multiple blanks in inverted mating configuration), (2) encloses the product on five or more sides yet has a convertible corner means that can provide space for storing an extra item, (3) has a bottom panel configuration that can provide full-length rectangular front and rear walls and a square cover, (4) has at least one wall that can be easily moved from an inward position to and outward position, and back again, and (5) can be partially folded and nested to conserve storage space.

The advantages of my invention are as follows:

1. Reduced packaging cost for pizza companies.
2. Maximum product containment and reduced slice separation in transit; reduced customer complaints.
3. Space for carrying an extra item in an eight-sided box.
4. A square cover and appearance of a square box.
5. Opportunity to use in-box pizza cutting with an eight-sided box with rigid walls.
6. Less space required to store set up boxes.

Further objects and advantages of the invention will become apparent from consideration of the following detailed description, related drawings, and appended claims, all of which form a part of this specification.

SUMMARY OF THE INVENTION

In accordance with the invention, a box is created that can incorporate one or more of four unique components, each component solving one or more problems and providing a number of advantages.

The first component is a special configuration of bottom panel that can accommodate five or more walls yet provide full-length front and rear walls and a square cover. This enables a pizza company to have the product containment of a pentagon, hexagon, or octagon box while having the aesthetic advantages of a square box.

The second component is side walls with a top edge that slopes downward toward the front or rear wall of the box. This allows for shorter front and rear walls, thereby reducing the amount of board used to make the box and also enabling multiple blanks to be inverted and mated during manufacture for material savings.

The third component is a convertible corner that enables a diagonal side wall to be converted to a square corner, and vice versa, thereby enabling a pizza company to carry an extra item in an eight-sided box.

The fourth component is a rectangular front or rear wall positioned adjacent to an obliquely angled wall, in which the length of the front or rear wall is equal to the width of the box. This enables a pizza company to have the product containment of a hexagon or octagon box while having more of the aesthetic appearance of a square box.

In addition, I disclose a structure, and a method that can be used with that structure, for partially folding and nesting boxes. Finally, I disclose a structure, and a method that can be used with that structure, for expanding and contracting the size of the inner cavity of a box.

The box is typically used for packaging relatively flat food products such as pizza and the like; however, it can serve other purposes, as well. A complete understanding of the invention can be obtained from the detailed description that follows.

LIST OF REFERENCE NUMERALS

Figure 2:
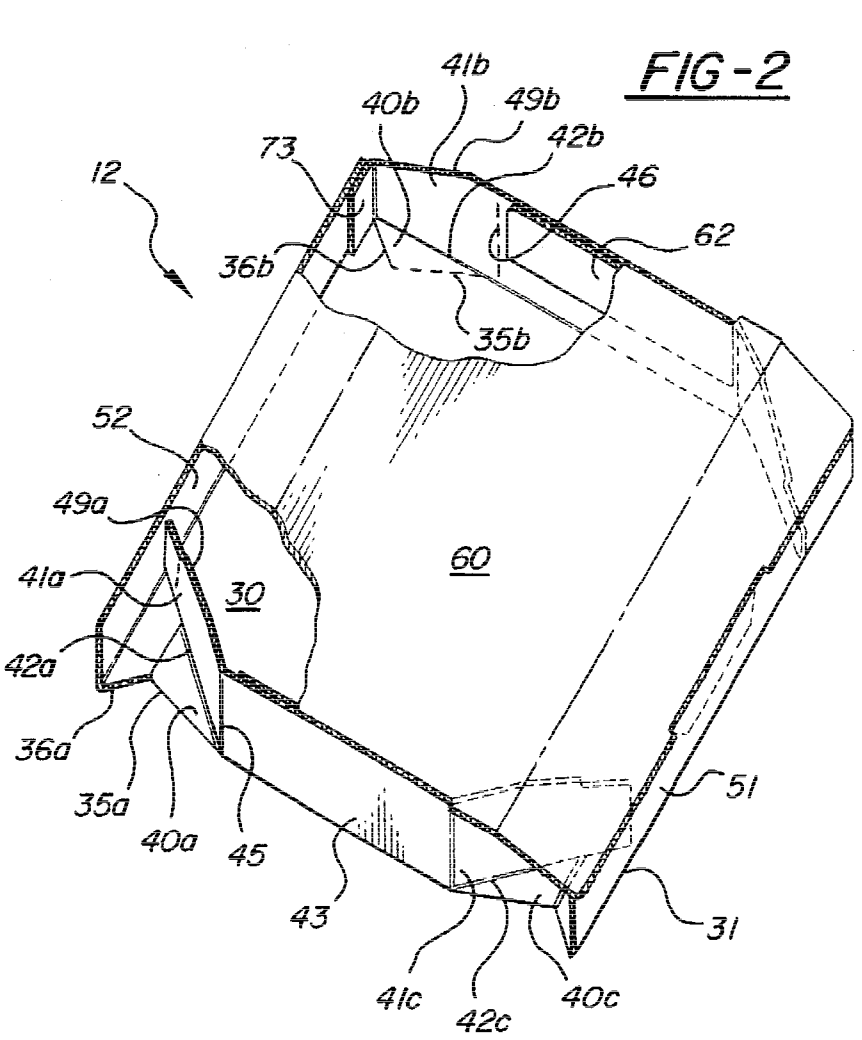
FIG. 2 is a perspective view of the box formed from the blank of FIG. 1.

Within a drawing, closely related figures have the same number but different alphabetic suffixes. Between drawings, like reference numerals designate corresponding parts.

11 blank of first preferred embodiment
**11*a*** first blank
**11*b*** second blank
12 box of first preferred embodiment
13 blank of second preferred embodiment
**13*a*** first blank
**13*b*** second blank
14 box of second preferred embodiment
30 bottom panel
31 front edge
32 rear edge
33 left side edge
34 right side edge
**35*a*** folder edge
**35*b*** folder edge
**35*c*** folder edge
**35*d*** folder edge
**36*a*** connector edge
**36*b*** connector edge
**36*c*** connector edge
**36*d*** connector edge
**37*a*** first diagonal wall edge
**37*b*** second diagonal wall edge
**39*a*** first set of corner-forming edges
**39*b*** second set of corner-forming edges
**39*c*** third set of corner-forming edges
**39*d*** fourth set of corner-forming edges
**40*a*** first hinge panel
**40*b*** second hinge panel
**40*c*** third hinge panel
**40*d*** fourth hinge panel
**41*a*** first angular side wall
**41*b*** second angular side wall
**41*c*** third angular side wall
**41*d*** fourth angular side wall
**42*a*** bottom edge
**42*b*** bottom edge
**42*c*** bottom edge
**42*d*** bottom edge
43 left side wall
44 right side wall
45 fold line
46 fold line
47 fold line
48 fold line
**49*a*** top edge
**49*b*** top edge
**49*c*** top edge
**49*d*** top edge
51 front wall
52 rear wall
53 flap
55 fold line
56 cover interlock slot
60 cover
61 left side flap
62 right side flap
63 fold line
64 fold line
65 front flap
66 fold line
71 fold line
72 fold line
73 folded portion
75 left diagonal flap
76 right diagonal flap
77 fold line
78 fold line
80 front end edge of blank
82 rear end edge of blank
**91*a*** first diagonal side wall
**91*b*** second diagonal side wall
**92*a*** first inner panel
**92*b*** second inner panel
**93*a*** top edge
**93*b*** top edge
**94*a*** cover interlock opening

94b cover interlock opening
95 flap
96 flap
97 flap
98 flap
101 fold line
102 fold line

DESCRIPTION OF THE PREFERRED EMBODIMENTS

There are two preferred embodiments and they both involve a box with eight walls consisting of a rear wall, front wall, left and right side walls, and first, second, third, and fourth angular, or diagonal, side walls.

It will be appreciated, as the description proceeds, that I am disclosing three special components: (1) a special configuration of bottom panel that can accommodate eight walls yet provide full-length rectangular front and rear walls and a square cover, (2) mating configuration for multiple blanks with sloping side walls, and (3) a convertible corner that enables an angular side wall to be converted to a square corner, and vice versa. In addition, my invention provides a structure that allows for nesting partially set up boxes, allows for converting a diagonal wall to a square corner, and allows for expanding and contracting the size of the inner cavity of a box. It will also be appreciated that my invention may be realized in different embodiments and may be used in other applications.

Figure 1:
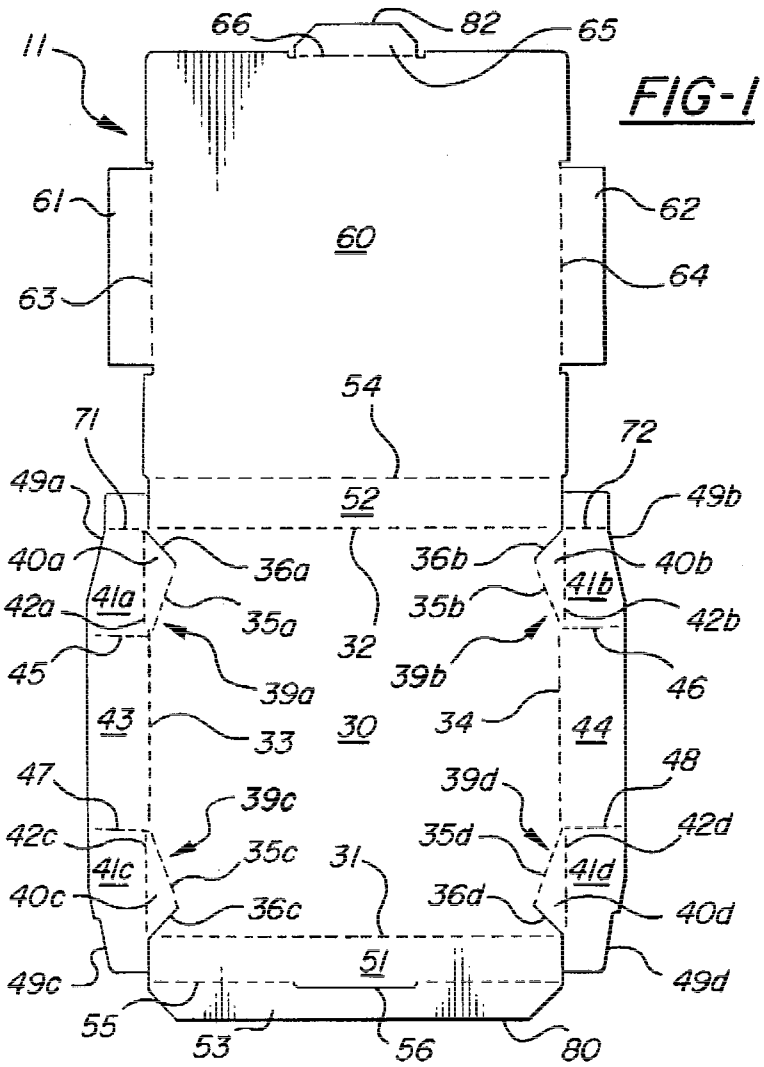
FIG. 1 is a plan view of a blank for making the box of the first preferred embodiment.
Figure 4:
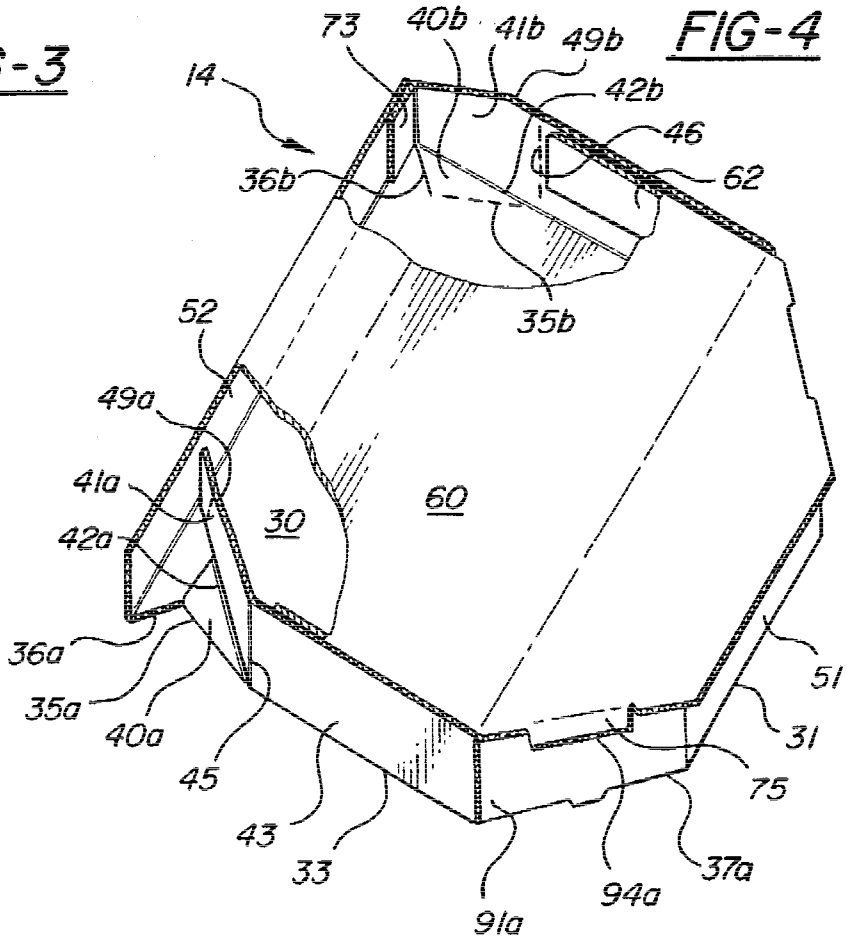
FIG. 4 is a perspective view of the box formed from the blank of FIG. 3.
Figure 3:
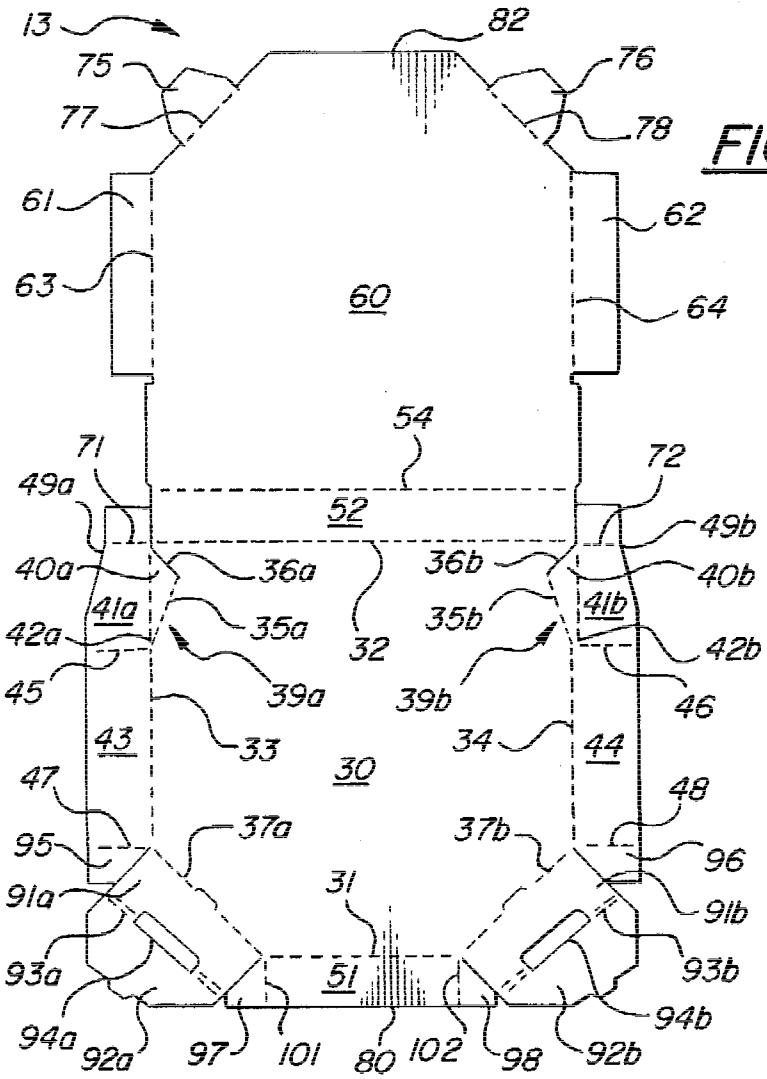
FIG. 3 is a plan view of a blank for making the box of the second preferred embodiment.

There is illustrated a first preferred embodiment of the invention in a one-piece blank 11 made of corrugated paperboard (FIG. 1) and, correspondingly, a box 12 created from the blank (FIG. 2). Following that, a second preferred embodiment is illustrated in a one-piece blank 13 made of corrugated paperboard (FIG. 3) and a box 14 created from the blank (FIG. 4).

Description of the First Embodiment

The following discussion describes blank 11, however, because the blank becomes box 12, by extrapolation the discussion also applies to box 12. To begin, blank 11 and, correspondingly, box 12 has a bottom panel 30. Panel 30 has a front edge 31, opposing rear edge 32, left side edge 33, and right side edge 34. In addition, bottom panel 30 has first, second, third, and fourth sets of corner-forming edges 39*a*, 39*b*, 39*c*, and 39*d*, respectively. Each set of corner-forming edges comprises a folder edge and a connector edge. Specifically, sets 39*a*–*d* comprise folder edges 35*a*, 35*b*, 35*c*, and 35*d*, respectively, along with connector edges 36*a*, 36*b*, 36*c* and 36*d*, respectively. Each folder edge extends from an end of an adjacent left edge 33 or right edge 34 toward and part way to front edge 31 or rear edge 32. Each connector edge extends from an end of a folder edge to an end of edge 31 or 32.

Left and right side walls 43 and 44, respectively, are hingedly attached to edges 33 and 34, respectively.

A front wall 51 is hingedly attached to edge 31 and a rear wall 52 is hingedly attached to edge 32. A flap 53 is hingedly attached to wall 51 at a fold line 55 and there is a cover interlock slot 56 disposed along fold line 55. A cover 60 is hingedly attached to a top edge of wall 52 at a fold line 54. Left and right side flaps 61 and 62 are hingedly attached to left and right sides of cover 60 at fold lines 63 and 64, respectively. A front flap 65 is hingedly attached to cover 60 at a fold line 66.

First, second, third, and fourth hinge panels 40*a*, 40*b*, 40*c*, and 40*d*, respectively, are hingedly attached to folder edges 35*a*–*d*, respectively. It is noted that each of hinge panels 40*a*–*d* has three edges: the first edge being defined by folder edges 35*a*–*d*, respectively, the second edge being defined by the fold line that connects the panel to walls 41*a*–*d*, respectively, and the third edge being defined by connector edges 36*a*–*d*, respectively, which are free from attachment.

First, second, third, and fourth angular side walls 41*a*, 41*b*, 41*c*, and 41*d*, respectively, are hingedly attached to panels 40*a*–*d*, respectively, at bottom edges 42*a*, 42*b*, 42*c*, and 42*d*, respectively. Angular side walls 41*a* and 41*b* are hingedly attached to the rear end of walls 43 and 44, respectively, at fold lines 45 and 46, respectively. Similarly, angular side walls 41*c* and 41*d* are hingedly attached to the front end of walls 43 and 44, respectively, at fold lines 47 and 48, respectively. For orientation purposes, it is noted that the front ends of walls 41*a* and 41*b* are the ends that are adjacent walls 43 and 44, respectively, and the rear ends are the ends adjacent rear wall 52. Similarly, it is noted that the rear ends of walls 41*c* and 41*d* are the ends that are adjacent walls 43 and 44, respectively, and the front ends are the ends adjacent front wall 51. Walls 41*a* and 41*b* have top edges 49*a* and 49*b*, respectively, which slope downward as they proceed from front to rear. Similarly, walls 41*c* and 41*d* have top edges 49*c* and 49*d*, respectively, which slope downward as they proceed from rear to front. As such, it is noted that the top and bottom edges of each of walls 41*a*–*d* are non-parallel and that there is a lesser distance between the top and bottom edges at the rear ends of walls 41*a* and 41*b* than at the front ends and there is a lesser distance at the front ends of walls 41*c* and 41*d* than at the rear ends.

A fold line 71 extends from top edge 49*a* to bottom edge 42*a* in wall 41*a* and, similarly, a fold line 72 extends from top edge 49*b* to bottom edge 42*b* in wall 41*b*. It is noted that fold lines 71 and 72 divide walls 41*a* and 41*b* into two portions-which, in the claims, are referred to as a body portion and an end portion, the end portion being adjacent rear wall 52.

Blank 11 has front and rear end edges 80 and 82, respectively, which are furthermost extremities of the blank. During manufacture of blanks, edge 80 of one blank is aligned with edge 82 of an adjacent blank.

The procedure for folding or setting up box 12 from blank 11 will now be explained. It will be described as if one person were giving directions to another. Simultaneously fold walls 41*a* and 41*b* partially upright and repeat the process with walls 41*c* and 41*d*. Simultaneously fold walls 43 and 44 upright and hold them there. This automatically folds walls 41*a*–*d* upright as well. While holding walls 43 and 44 upright and with cover 60 position against the body, roll the box over so it bends at fold line 32, until you can grasp flaps 61 and 62 and then tuck them to the inside of walls 43 and 44. Then fold wall 51 upright and fold flap 53 inward and, finally, tuck flap 65 into slot 56. When completed, hinge panels 40*a*–*d* overlie a portion of bottom panel 30.

Extra space in the box can be created by converting either of walls 41*a* or 41*b* into a square corner. Using wall 41*b* as an example, this would be accomplished by the following procedure. Starting with a pre-folded box and with the cover open, push wall 41*b* outward to a coplanar position with wall 44. In doing this, panel 40*b* would change position from overlying bottom panel 30 to being coplanar with bottom panel 30. Then fold the rear end of wall 41*b* inward at fold line 72, thereby creating an angled end portion 73 at the rear end of the wall, which is shown in FIGS. 2 and 4. Then reclose the box, thereby enclosing the end portion inside of the box and positioning it adjacent and parallel to rear wall 52. FIGS. 2 and 4 show boxes 12 and 14, respectively, with a corner formed in wall 41*b*. However, if no corner were formed, wall 41*b* would be disposed at an oblique angle to wall 44, similar to the way wall 41*a* is disposed to wall 43.

Description of the Second Embodiment

The following discussion describes blank 13, however, because the blank becomes box 14, by extrapolation the discussion also applies to box 14.

To begin, blank 13 and, correspondingly, box 14 has a bottom panel 30. Panel 30 has a front edge 31, opposing rear edge 32, left side edge 33, and right side edge 34. It also has first and second diagonal wall edges 37*a* and 37*b*, respectively. Finally, bottom panel 30 has first and second sets of corner-forming edges 39*a* and 39*b*, respectively. Each set of corner-forming edges comprises a folder edge and a connector edge. Specifically, sets 39*a* and 39*b* comprise folder edges 35*a* and 35*b*, respectively, along with connector edges 36*a* and 36*b*, respectively. Edge 35*a* extends from a rear end of left edge 33 toward and part way to rear edge 32. Edge 35*b* extends from a rear end of right edge 34 toward and part way to rear edge 32. Edge 36*a* extends from an end of edge 35*a* to the left end of edge 32. Edge 36*b* extends from an end of edge 35*b* to the right end of edge 32.

Left and right side walls 43 and 44, respectively, are hingedly attached to edges 33 and 34, respectively. Flaps 95 and 96 are hingedly attached to the front end of walls 43 and 44, respectively, at fold lines 47 and 48, respectively.

A front wall 51 is hingedly attached to edge 31 and a rear wall 52 is hingedly attached to edge 32. Flaps 97 and 98 are hingedly attached to the left and right ends, respectively, of wall 51 at fold lines 101 and 102, respectively. A cover 60 is hingedly attached to a top edge of wall 52 at a fold line 54. Left and right side flaps 61 and 62 are hingedly attached to left and right sides of cover 60 at fold lines 63 and 64, respectively. Left and right diagonal flaps 75 and 76, respectively, are hingedly attached to left and right diagonal edges of cover 60 at fold lines 77 and 78, respectively.

First and second hinge panels 40*a* and 40*b*, respectively, are hingedly attached to folder edges 35*a* and 35*b*, respectively.

First and second angular side walls 41*a* and 41*b*, respectively, are hingedly attached to panels 40*a* and 40*b*, respectively, at bottom edges 42*a* and 42*b*, respectively. Walls 41*a* and 41*b* are hingedly attached to the rear end of walls 43 and 44, respectively, at fold lines 45 and 46, respectively. For orientation purposes, it is noted that the front ends of walls 41*a* and 41*b* are the ends that are adjacent walls 43 and 44, respectively, and the rear ends are the ends adjacent wall 52. Walls 41*a* and 41*b* have top edges 49*a* and 49*b*, respectively, which slope downward as they proceed from front to rear. As such, it is noted that the top and bottom edges of each of walls 41*a* and 41*b* are non-parallel and that there is a lesser distance between the top and bottom edges at the rear ends than at the front ends.

A fold line 71 extends from top edge 49*a* to bottom edge 42*a* in wall 41*a* and, similarly, a fold line 72 extends from top edge 49*b* to bottom edge 42*b* in wall 42*b*.

First and second diagonal side walls 91*a* and 91*b* are hingedly attached at their bottom edge to edges 37*a* and 37*b*, respectively. Therefore, in the drawings, the dashed lines indicated by 37*a* and 37*b* also define the location of the bottom edges of walls 91*a* and 91*b*, respectively. First and second inner panels 92*a* and 92*b*, respectively, are hingedly attached to top edges 93*a* and 93*b*, respectively, of walls 91*a* and 91*b*, respectively. Contained within walls 91*a* and 91*b* are cover interlock openings 94*a* and 94*b*, respectively. For orientation purposes, it is noted that the rear ends of walls 91*a* and 91*b* are the ends that are adjacent walls 43 and 44, respectively, and the front ends are the ends adjacent wall 51. Top edges 93*a* and 93*b* slope downward as they proceed from rear to front. As such, it is noted that the top and bottom edges of each of walls 91*a* and 91*b* are non-parallel and that there is a lesser distance between the top and bottom edges at the front ends of walls 91*a* and 91*b* than at the rear ends.

Blank 13 has front and rear end edges 80 and 82, respectively, which are furthermost extremities of the blank. During manufacture of blanks, edge 80 of one blank is aligned with edge 82 of an adjacent blank.

The procedure for folding or setting up box 14 from blank 13 will now be explained. It will be described as if one person were giving directions to another. Simultaneously fold walls 41*a* and 41*b* partially upright. Fold walls 43, 44, and 51 to an upright position. Fold walls 91*a* and 91*b* upright and then fold panels 92*a* and 92*b* down until they lock into place thereby creating double-panel diagonal walls which enclose flaps 95 and 96. This automatically holds walls 51, 43, 44, 41*a*, and 41*b* upright. Fold the box over until you can grasp flaps 61 and 62 and then tuck them to the inside of walls 43 and 44. Then, while the cover is still partially open, fold flaps 75 and 76 inward and tuck them into openings 94*a* and 94*b*, respectively, and finish closing the cover.

Box 14 has a convertible corner on walls 41*a* and 41*b* which works the same as described for box 12.

Variations of Connector Edges

Figure 8:
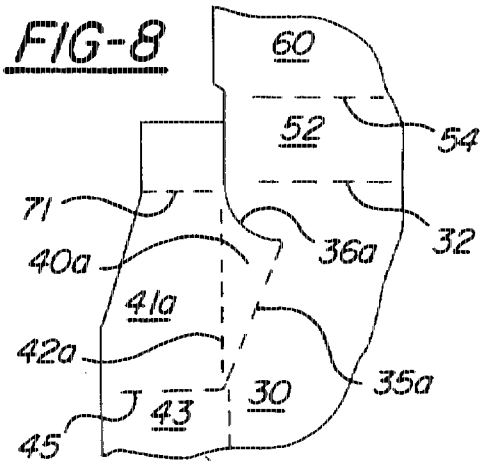
FIG. 8 is a plan view of a section of bottom panel showing a curved connector edge.
Figure 9:
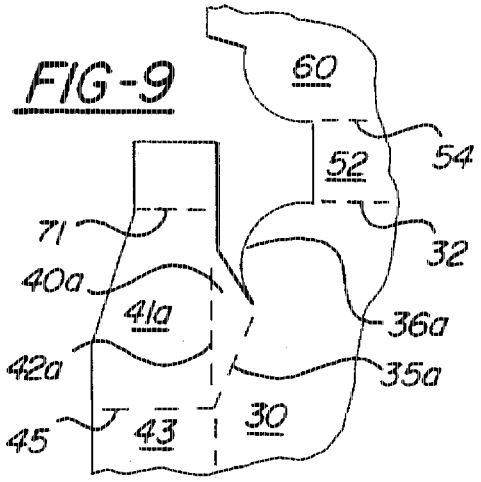
FIG. 9 is a plan view of a section of bottom panel showing another variation of curved connector edge.
Figure 10:
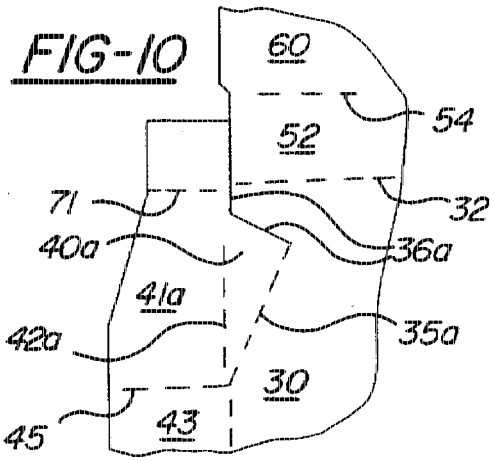
FIG. 10 is a plan view of a section of bottom panel showing a connector edge comprised of two adjoining straight edges.
Figure 11:
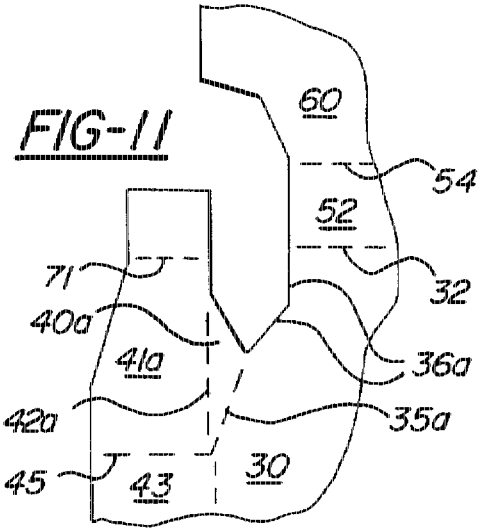
FIG. 11 is plan view of a section of bottom panel showing another variation of a connector edge comprised of two adjoining straight edges.
Figure 12:
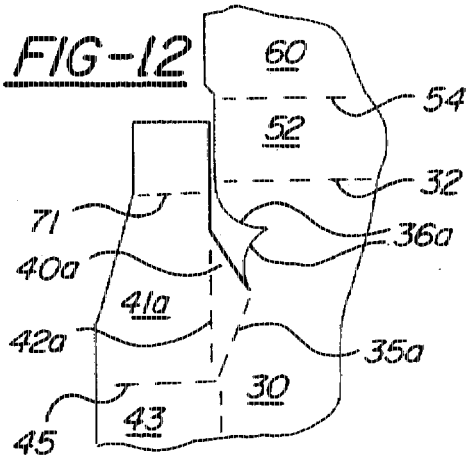
FIG. 12 is a plan view of a section of bottom panel showing a connector edge comprised of two adjoining curved edges.
Figure 13:
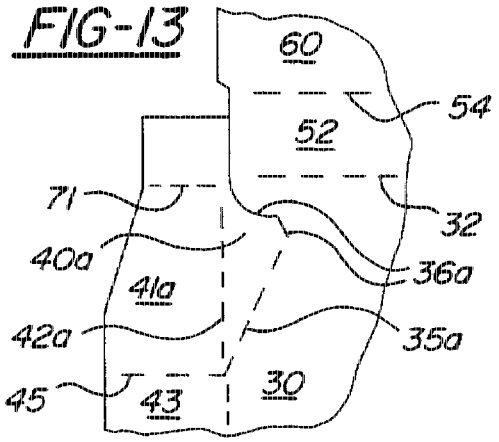
FIG. 13 is a plan view of a section of bottom panel showing a connector edge comprised of a straight edge adjoining a curved edge.

The preferred embodiments show a preferred configuration for connector edges 36*a*–*d*, which happens to be a straight edge. However, other configurations are possible, including curved, jagged, arcuate, curvilinear, and combinations of adjoining edges such as two adjoining straight edges, two adjoining curved edges, and a straight edge adjoining a curved edge. Examples of some of these configurations are shown in FIGS. 8–13. FIGS. 8 and 9 show a curved connector edge. FIGS. 10 and 11 show a connector edge comprising two adjoining straight edges. FIG. 12 shows a connector edge comprising two adjoining curved edges. FIG. 13 shows a connector edge comprising a straight edge adjoining a curved edge.

Procedure for Expanding and Contracting the Size of the Inner Cavity

Figure 7:
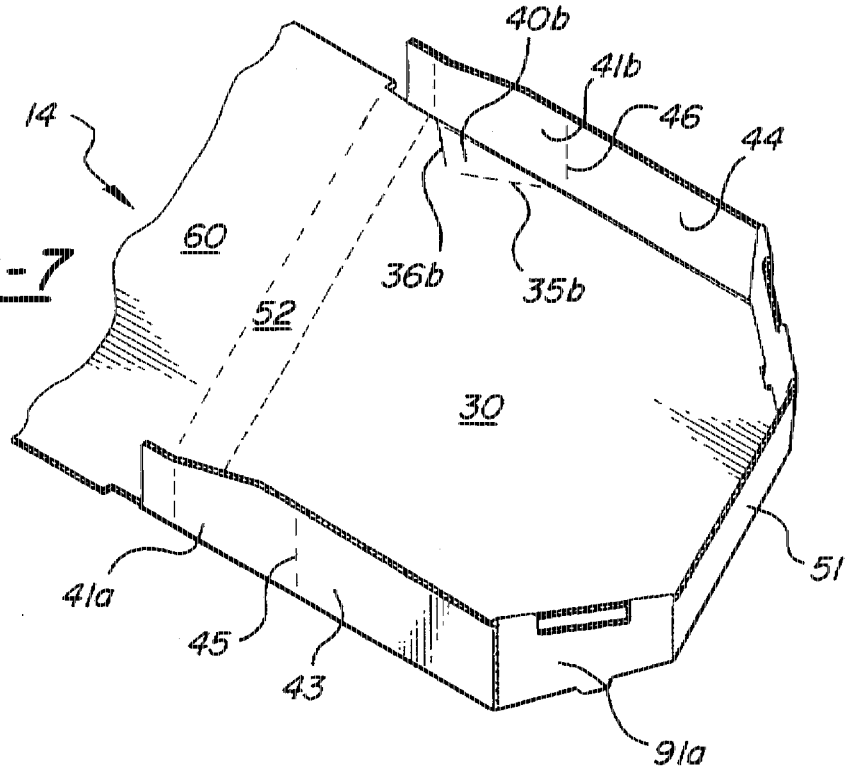
FIG. 7 is a perspective view of box 14 partially folded or erected, ready for nesting.

As can be seen by comparing box 14 of FIG. 4 to that of FIG. 7, angular side walls 41*a* and 41*b* can assume two positions: an inward position and an outward position. Using wall 41*a* as an example, the inward position, wall 41*a* is disposed at an oblique angle to wall 43 and hinge panel 40*a* overlying bottom panel 30. In the outward position, wall 41*a* is disposed coplanar with wall 43 and panel 40*a* is coplanar with bottom panel 30. The inward position is shown in FIG. 4 and the outward position is shown in FIG. 7. When moved from the inward position to the outward position, the size of the inner cavity of the box is expanded. Conversely, when moved from the outward position to the inward position, the size of the cavity is contracted.

To allow in-box pizza cutting, a special procedure can be used with box 14. The procedure is as follows. Starting with a folded box and with walls 41*a* and 41*b* in the inward position, open the cover of the box. Then move walls 41*a* and 41*b* to the outward position by folding hinge panels 40*a* and 40*b* to a coplanar position with bottom panel 30. Place the pizza into the box and, if desired, cut it. Finally, to close the box, move walls 41*a* and 41*b* back to the inward position by folding panels 40*a* and 40*b* to overlie bottom panel 30.

Procedure for Partially Erecting and Nesting Boxes

Figure 14:
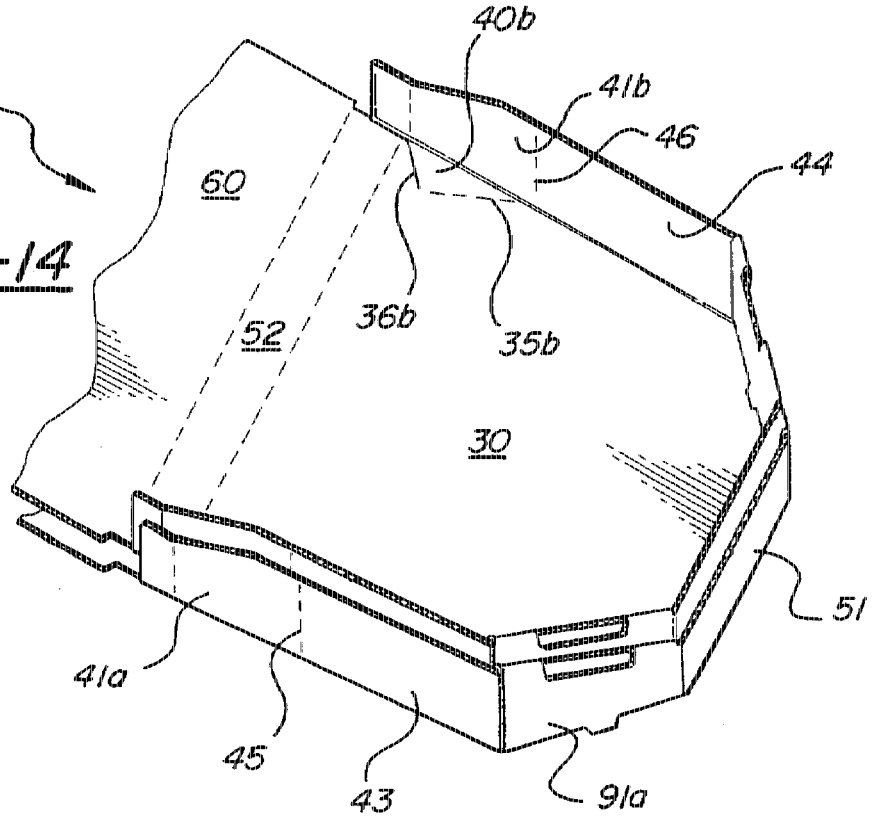
FIG. 14 is a perspective view of two units of box 14 partially folded and nested together.

To conserve space normally allocated to storing folded boxes, a special procedure can be used with box 14, as illustrated with FIGS. 7 and 14. The procedure involves partially erecting the blank into box, then nesting multiple boxes together for storage, and then unnesting them and fully erecting them into boxes when needed for use. The procedure is as follows. Fold walls 43, 44, and 51 to upright position. Fold walls 91*a* and 91*b* to upright position and then fold panels 92*a* and 92*b* down until they lock into place. Walls 43, 44, 91*a*, 91*b*, and 51 will now be locked upright. In addition, walls 41*a* and 41*b* will be upright and extending coplanar off the rear ends of walls 43 and 44, respectively, or in the outward position. At this point, the box is now ready for nesting. This configuration is shown in FIG. 7.

To continue, place the partially folded box onto a table. Fold a second blank following the above procedure. Then, to store it, set it on top of the first box and nest the two together. This arrangement is shown in FIG. 14. This is repeated until a stack of nested partially fold boxes is created. They are then stored. When needed for use, a partially folded box is pulled from the stack and, to complete the folding, walls 41*a* and 41*b* are simultaneously pushed inward, which will cause hinge panels 40*a* and 40*b* to change from a coplanar position with bottom panel 30 to overlying panel 30, and, as a result, will move walls 41*a* and 41*b* to the inward position, or at an oblique angle to walls 43 and 44, respectively.

Manufacture of Mating Blanks

Figure 5:
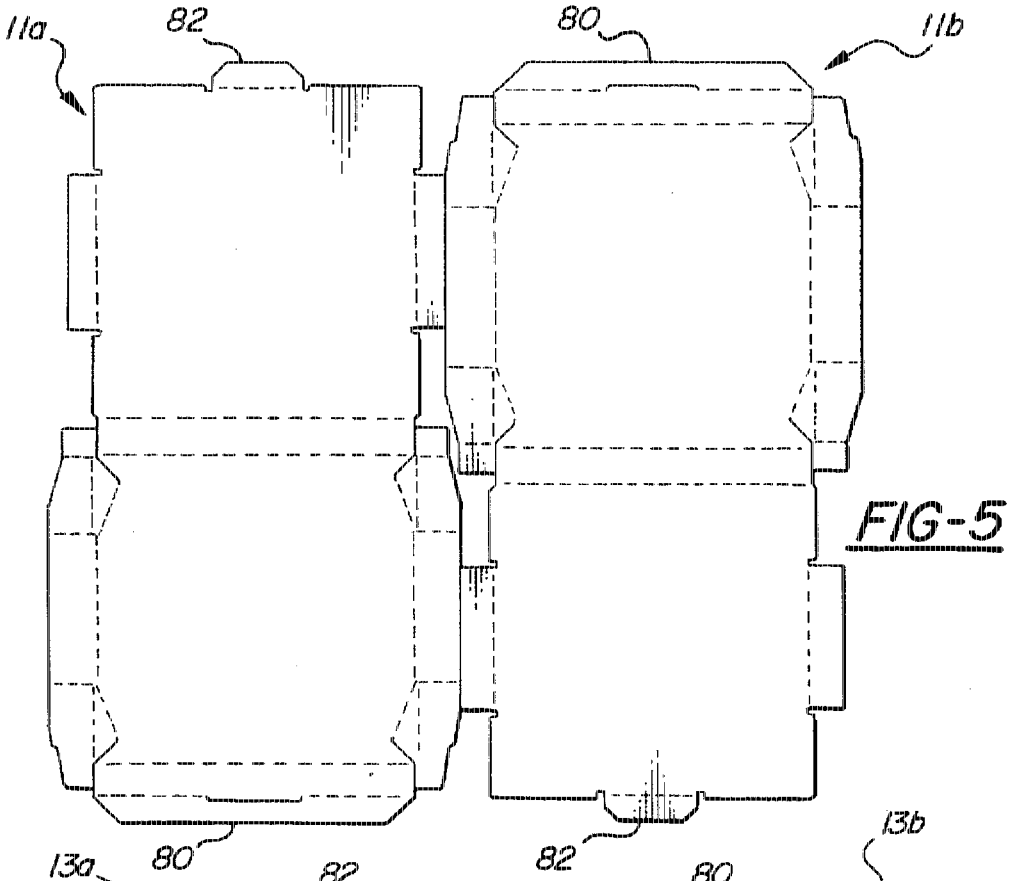
FIG. 5 is a plan view of two blanks of FIG. 1 shown side-by-side in cutting die arrangement.
Figure 6:
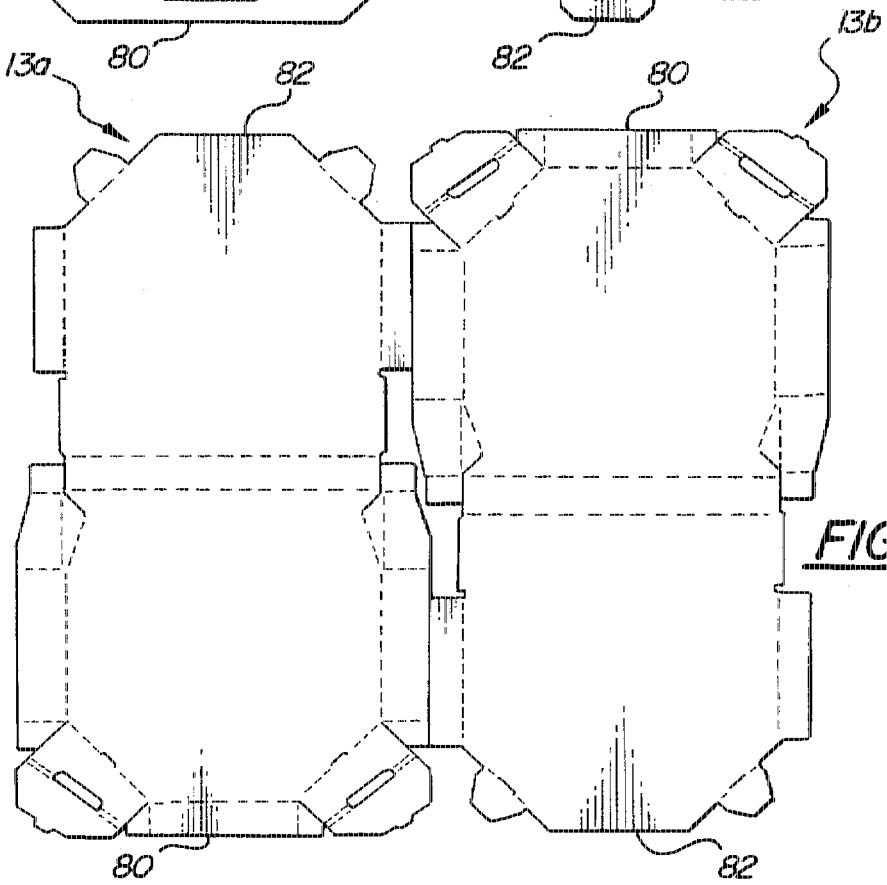
FIG. 6 is a plan view of two blanks of FIG. 3 shown side-by-side in cutting die arrangement.

As previously noted, blanks 11 and 13 can be manufactured in inverted mating configuration, or with two or more blanks disposed side-by-side and oriented at one hundred eighty degrees from each other and nested together. For maximum savings, the end edges of adjacent blanks must align. FIG. 5 shows first and second blanks 11*a* and 11*b*, respectively, (which are copies of blank 11) in inverted mating configuration. Similarly, FIG. 6 shows first and second blanks 13*a* and 13*b*, respectively (which are copies of blank 13).

Blanks 11 and 13 have front and rear end edges 80 and 82, respectively, which are the furthermost extremities of the blank. During manufacture of blanks, edge 80 of one blank is aligned with edge 82 of an adjacent blank, thereby reducing material usage to a minimum.

it is noted that in the inverted matin configuration, a rear angular side wall of the first blank is disposed adjacent to the corresponding angular side wall of the second blank. In FIGS. 5 and 6, the corresponding angular side walls happen to be 41*b* (not marked in FIGS. 5 and 6 but shown in FIGS. 1 and 3). Finally, it is noted that the position of the blanks can be reversed, whereupon the corresponding angular side walls would then be 41*a*.

Lastly, within the context of this invention, a fold line can be created by a number of means such as, for example, by a crease or score in the board, by a series of aligned spaced short slits in the board, and by a combination of aligned spaced short and long slits. In some cases, when a long slit is bounded on the ends by a series of short slits or a score, the long slit may be slightly offset in alignment from the short slits or score for the purpose of creating a slot along the fold line when the blank is set up into a box. Nonetheless, the entire combination of long and short slits is considered to constitute a single fold line unless otherwise indicated. In addition, to create a fold line where one panel is folded 180° to lay parallel on another panel, the fold line may constitute two narrowly spaced parallel scores or series of aligned slits. In this case, the two narrowly spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a type of blank and box that embodies one or more of four unique components: (1) a special configuration of bottom panel that can accommodate five or more walls yet provide full-length rectangular front and rear walls and a square cover, (2) mating configuration for multiple blanks with sloping side walls, (3) a convertible corner that enables a diagonal side wall to be converted to a square corner, and vice versa, for creating extra space in an octagon box and (4) a full-width rectangular front or rear wall positioned adjacent to an obliquely angled wall on a box having five or more walls. In addition, I have disclosed a structure, and a method that can be used with that structure, for partially folding and nesting boxes to conserve storage space. Finally, I have disclosed a structure, and a method that can be used with that structure, for expanding and contracting the size of the inner cavity of the box.

The primary advantages of my invention are reduced packaging cost, better product containment during delivery, opportunity to use an eight-sided box yet have space when needed for carrying extra items, opportunity to have full-length rectangular front and rear walls and a square cover on an eight-sided box, and reduction in storage space needed for set up boxes.

The illustrated number, size, shape, type, and placement of components represent the preferred embodiment; however, many other combinations and configurations are possible within the scope of the invention.

In conclusion, it is understood that my invention is not to be limited to the disclosed embodiments but, on the contrary, is intended to cover various modifications and equivalent arrangements included within the spirit and scope of the appended claims.

I claim:

1. A one-piece blank of foldable material cut and scored to define:

a bottom panel having front and rear edges, left and right side edges, a first folder edge, and a first connector edge, said first folder edge extending from an end of one of the left and right side edges toward one of the front and rear edges and said first connector edge extending from an end of the folder edge to an end of one of said front and rear edges, a first hinge panel hingedly attached to said first folder edge, a first angular side wall having a top edge, bottom edge, front end, and rear end, and hingedly attached at the bottom edge to said first hinge panel, left and right side walls hingedly attached to said left and right side edges, respectively, one of said left and right side walls being hingedly attached to said first angular side wall, a front wall hingedly attached to said front edge of the bottom panel, a rear wall hingedly attached to said rear edge of the bottom panel.

2. The blank defined in claim 1 wherein:

said connector edge is straight.

3. The blank defined in claim 1 wherein:

said connector edge is curved.

4. The blank defined in claim i wherein:

said connector edge is comprised of at least two adjoining straight edges.

5. The blank defined in claim 1 wherein:

said foldable material is corrugated paperboard, the first angular side wall has a fold line extending from said top edge to said bottom edge, said fold line dividing the angular side wall into a body portion and an end portion, the above-described bottom panel, hinge panel, walls, edges, and fold line being of such shape and position that, after said blank is folded into a box, said first angular side wall may be erected at an oblique angle to said one of said left and right side walls by folding said hinge panel to overlie said bottom panel or said first angular side wall may be erected coplanar with said one of said left and right side walls by keeping said hinge panel approximately coplanar with said bottom panel, whereby said first angular side wall and said one of said left and right side walls form a single wall, in effect, and a corner may be formed at an end of said single wall by folding said single wall at said fold line.

6. The blank defined in claim 1:

wherein said foldable material is corrugated paperboard;

said blank further comprising:

a second folder edge and a second connector edge, said second folder edge extending from an end of one of the left and right side edges toward one of the front and rear edges and said second connector edge extending from an end of one of the folder edges to an end of one of said front and rear edges, a second hinge panel hingedly attached to said second folder edge second, a second angular side wall hingedly attached at a bottom edge to said second hinge panel, one of said left and right side walls being hingedly attached to said second angular side wall.

7. The blank defined in claim 6, said blank further comprising:

third and fourth folder edges and third and fourth connector edges, said third and fourth folder edges extending from an end of the left and right side edges, respectively, toward one of the front and rear edges and said third and fourth connector edges extending from an end of said third and fourth folder edges, respectively, to an end of one of said front and rear edges, third and fourth hinge panels hingedly attached to said third and fourth folder edges, respectively, third and fourth angular side walls hingedly attached at a bottom edge to said third and fourth hinge panels, respectively.

8. The blank defined in claim 7 wherein:

said front and rear edges have left and right ends, said left and right ends are approximately aligned with said left and right side edges, respectively.

9. The blank defined in claim 6, said blank further comprising:

first and second diagonal wall edges on said bottom panel, said first and second diagonal wall edges extending between one of said front and rear edges and said left and right side edges, respectively, first and second diagonal side walls hingedly attached to said first and second diagonal edges, respectively, and each having a top edge, bottom edge, front end, and rear end.

10. The blank defined in claim 9 wherein:

said top and bottom edges of said first and second diagonal side walls are non-parallel and the distance between said top and bottom edges at one of said front and rear ends is substantially less than the distance between said top and bottom edges at the other of said front and rear ends.

11. A one-piece blank of foldable material cut and scored to define:

a bottom panel, a plurality of walls, and a cover hingedly attached to one of the walls, said bottom panel having first and second angularly oriented edges and a third edge extending from an end of the first edge toward and at least part way to the second edge, said plurality of walls comprising first and second walls hingedly attached to the first and second edges, respectively, the first wall having an end adjacent an end of the second wall, said plurality of walls further comprising a third wall having an end hingedly attached to said end of the first wall and having a top edge and a bottom edge, a hinge panel connecting said third wall to said bottom panel, said hinge panel having a first hinge panel edge hingedly attached to the third edge of the bottom panel, a second hinge panel edge hingedly attached to the bottom edge of the third wall, and a third hinge panel edge that is free from attachment and extends from the first hinge panel edge, a fold line within said third wall and extending from the top edge to the bottom edge, the above-described bottom panel, hinge panel, walls, edges, and fold line being of such shape and position that, after said blank is folded into a box, said third wall may be erected at an oblique angle to said first wall by folding said hinge panel to overlie said bottom panel or said third wall may be erected coplanar with said first wall by keeping said hinge panel approximately coplanar with said bottom panel, whereby said first and third walls form a single wall, in effect, and a corner may be formed at an end of said single wall by folding said single wall at said fold line.

12. The blank defined in claim 11 wherein:

said foldable material is corrugated paperboard, said third edge on the bottom panel extends from said end of the first edge and terminates at a first point part way to the second edge, a fourth edge extends from said first point to an end of said second edge, said end of said second edge is in approximate alignment with said first edge.

13. A box comprising:

a bottom panel and a plurality of walls, said bottom panel having angularly oriented first and second edges, a folder edge, and a connector edge, said folder edge extending from an end of said first edge toward and part way to said second edge and said connector edge extending from an end of said folder edge to an end of said second edge, a hinge panel hingedly attached to said folder edge, said plurality of walls comprising first and second walls hingedly attached to said bottom panel at said first and second edges, respectively, said plurality of walls further comprising a third wall having a top edge, bottom edge, front end, and rear end, and hingedly attached at the bottom edge to said hinge panel and hingedly attached to an end of said first wall.

14. The box defined in claim 13 wherein:

said third wall has a fold line within it and extending from said top edge to said bottom edge.

15. A box comprising:

a bottom panel having opposing front and rear edges and opposing left and right side edges, a predetermined width to said bottom panel, said predetermined width extending between said left and right side edges, front, rear, left side, and right side walls hingedly attached to said front, rear, left side, and right side edges, respectively, a first angular wall disposed at an oblique angle to one of the left and right side walls, said first angular wall extending from said one of the left and right side walls toward one of the front and rear walls, a first hinge panel hingedly attached to a bottom edge of said first angular wall and hingedly attached to said bottom panel and overlying said bottom said one of the front and rear walls being of substantially rectangular shape and having a predetermined length, said predetermined length being substantially equal to said predetermined width of the bottom panel.

16. The box defined in claim 15:

wherein:

said box is made of foldable material, said front and rear walls are parallel and said left and right side walls are parallel;

said box further comprising:

a second angular wall disposed at an oblique angle to one of the left and right side walls, said second angular wall extending from said one of the left and right side walls toward one of the front and rear walls, a second hinge panel hingedly attached to a bottom edge of said second angular wall and hingedly attached to said bottom panel and overlying said bottom panel, a cover hingedly attached to said rear wall, each of said front and rear walls being of substantially rectangular shape and having a predetermined length, said predetermined length being substantially equal to said predetermined width of the bottom panel.

17. A one-piece blank of foldable material cut and scored to define:

a bottom panel having opposing first and second end edges, opposing left and right side edges, and a first folder edge, said first folder edge being disposed at an oblique angle to one of the left and right side edges and extending from an end of said one of the left and right side edges toward the first end edge, a predetermined width to said bottom panel, said predetermined width extending between said left and right side edges, first end, second end, left side, and right side walls hingedly attached to said first end, second end, left side, and right side edges, respectively, a first angular wall hingedly attached to an end of one of the left and right side walls, a first hinge panel hingedly attached to said first angular edge and to a bottom edge of said first angular wall, said first end wall being of approximately rectangular shape and having a predetermined length, said predetermined length being approximately equal to said predetermined width of the bottom panel.

18. The blank defined in claim 17:

wherein:

said foldable material is corrugated paperboard, said first and second end edges are parallel and said left and right side edges are parallel;

said blank further comprising:

second, third, and fourth folder edges each disposed at an oblique angle to one of the left and right side edges and extending from an end of said one of the left and right side edges toward one of the first and second end edges, second, third, and fourth angular walls each hingedly attached to an end of one of the left and right side walls, second, third, and fourth hinge panels hingedly attached to said second, third, and fourth angular edges, respectively, and to a bottom edge of said second, third, and fourth angular walls, respectively, a cover hingedly attached to said rear wall, each of said first and second end walls being of approximately rectangular shape and having a predetermined length, said predetermined length being approximately equal to said predetermined width of the bottom panel.

19. In a box made of foldable material, said box comprising a bottom panel having angularly oriented first and second edges, a first wall hingedly attached to said first edge, a second wall hingedly attached to said second edge, an angular wall hingedly attached to an end of said first wall and extending toward said second wall, a hinge panel hingedly attached to a bottom edge of said angular wall and overlying said bottom panel, an improvement comprising:

a plurality of adjoining edges extending between said first and second edges on said bottom panel, said plurality of adjoining edges comprising a folder edge extending from an end of said first edge and a connector edge extending from an end of said second edge, said hinge panel being hingedly attached to said folder edge.

20. A one-piece blank of foldable material cut and scored to define:

a bottom panel, a plurality of walls, and a cover hingedly attached to a top edge of one of the walls, said bottom panel having left and right side edges and first and second diagonal wall edges extending at an oblique angle from an end of said left and right side edges, respectively, said plurality of walls comprising:

(a) left and right side walls hingedly attached to said left and right side edges, respectively, and having first and second ends, the second end of the left side wall being disposed adjacent said first diagonal wall edge and the second end of said right side wall being disposed adjacent said second diagonal wall edge, (b) first and second angular side walls hingedly attached to the first end of said left and right side walls, respectively, (c) first and second hinge panels hingedly attached to a bottom edge of said first and second angular side walls, respectively, (d) first and second diagonal side walls hingedly attached to said first and second diagonal wall edges, respectively, (e) first and second inner panels hingedly attached to a top edge of said first and second diagonal side walls, respectively, (f) first and second flaps hingedly attached to the second end of said left and right side walls, respectively;

whereby, after said left and right side walls and said first and second diagonal side walls have been erected to upright position, the first and second angular side walls can be moved from an inward position to an outward position and from an outward position to an inward position.

21. The blank of claim 20 wherein at least one of said first and second angular side walls has a fold line disposed between the bottom edge and a top edge.

22. The blank of claim 20 wherein said first and second hinge panels are hingedly attached to said bottom panel.

23. A box comprising a bottom panel, a plurality of walls, and a cover hingedly attached to one of the walls, said plurality of walls comprising:

(a) a first side wall hingedly attached to said bottom panel and having first and second ends, (b) an angular side wall hingedly attached to the first end of said first side wall and disposed in an obliquely-angled position to said first side wall and a movable hinge panel hingedly attached to a bottom edge of said angular side wall and overlying said bottom panel, (c) a diagonal side wall hingedly attached to said bottom panel and disposed at an oblique angle to said first side wall, (d) an inner panel hingedly attached to a top edge of said diagonal side wall and disposed parallel to said diagonal side wall, (e) a flap hingedly attached to the second end of said first side wall and disposed between said diagonal side wall and said inner panel;

whereby said angular side wall can be moved from said obliquely-angled position to a substantially coplanar position to said first side wall and said first side wall maintains an upright position after said angular side wall has been moved because of said flap being disposed between said diagonal side wall and said inner panel.

24. A box of foldable material, said box comprising:

a bottom panel having opposing front and rear edges, a side edge, and an angular edge extending from said side edge toward and at least part way to one of said front and rear edges;

front and rear walls hingedly attached to said front and rear edges, respectively;

a cover hingedly attached to said rear wall;

a first wall hingedly attached to said side edge and having a first end disposed adjacent said angular edge;

a second wall hingedly attached to the first end of said first wall;

a movable hinge panel hingedly attached to a bottom edge of said second wall and disposed substantially coplanar to said bottom panel.

25. The box of claim 24, wherein said box is partially folded and said front wall and said first and second walls are each disposed in an upright position and said rear wall is disposed substantially coplanar with said bottom panel.

26. The box of claim 24, wherein said movable hinge panel is hingedly attached to said bottom panel.

27. The box of claim 24, wherein said second wall has a fold line extending from a top edge to a bottom edge.

28. The box of claim 24, wherein said second wall is disposed in a substantially coplanar position to said first wall.

* * * * *